US005195439A

United States Patent [19]

Harder

[11] Patent Number: 5,195,439

[45] Date of Patent: Mar. 23, 1993

[54] SHIPMENT PALLET FOR HEAVY AND SENSITIVE EQUIPMENT

[76] Inventor: Melvin S. Harder, 2434 Alvardo Dr., Santa Clara, Calif. 95051-1305

[21] Appl. No.: 856,745

[22] Filed: Mar. 24, 1992

[51] Int. Cl.[5] ..... B65D 19/00

[52] U.S. Cl. ..... 108/51.1; 108/901

[58] Field of Search ..... 108/51.1, 51.3, 55.5, 108/55.1, 56.1

[56] References Cited

U.S. PATENT DOCUMENTS

| | | | |
|---|---|---|---|
| 4,809,847 | 3/1989 | Schneider | 206/45.31 |
| 4,927,026 | 5/1990 | Glosser | 206/600 |
| 5,039,036 | 8/1991 | Rogers | 244/138 |

FOREIGN PATENT DOCUMENTS

| | | | |
|---|---|---|---|
| 0671203 | 8/1989 | Switzerland | 108/51.1 |

*Primary Examiner*—Kenneth J. Dorner
*Assistant Examiner*—Gerald A. Anderson

[57] ABSTRACT

A cushioned pallet which combines the shock absorbing characteristics of lower density foam cushions with the vibration damping characteristics of higher density foam cushions. In particular, an inventive packaging pallet which utilizes a load bearing tri-pod arrangement with different density cushions strategically located to produce the desired effect of reducing both shock and vibration force inputs with one pallet design.

4 Claims, 6 Drawing Sheets

SHIPMENT PALLET FOR HEAVY AND SENSITIVE EQUIPMENT

BACKGROUND OF THE INVENTION

This invention relates to the design of a shipment pallet for heavy and sensitive electronic equipment. The purpose of the shipment pallet is to reduce the distribution environment's shock and vibration force levels (g's) below the break points of the equipment so that the equipment will arrive at its destination functionally operational and cosmetically intact.

Prior art dictates the use of cushioning material to moderate the shocks and vibrations incurred in the distribution system (i.e. trucks, trains, airplanes, ships). As illustrated in FIG. 1, this is done by adding a cushioning layer 21 between two top deck boards 22 and 23 or as illustrated in FIG. 2, adding the cushioning layer 21 between the top of the stringers 24 and the top deck board 22. The performance of the cushioning material is published by the cushion manufacturer and the designer calculates the density and amount of material required in the design.

When designing cushions for packaging, there is a trade-off between shock and vibration. When a cushion is designed that will lower the destructive g's for shock, the vibration g's increase. In the lower g ranges for shock (15g's–35 g's), this inverse sensitivity amplifies and any minor reduction in the shock g's results in a major increase in the vibration g's.

Quite often, the engineer can design a cushion that will reduce the shock g's below the break point of the equipment only to fine out that he has inadvertently raised the vibration g's above the allowable limit, thus destroying the equipment with vibration damage in the distribution system. When the vibration problem is solved using a stiffer, more dense cushion, the shock g's are corresponding increased causing shock damage. When the shock damage is resolved by using a softer, less dense cushion the vibration g's are increased causing the vibration damage again. The cycle goes on and on with the engineer bouncing back and forth between solving shock damage and incurring vibration damage and solving vibration damage while incurring shock damage. As you can see, there was a bottom limit to any cushion design the engineer could create which was bound by this inverse relationship between shock and vibration.

In the art today, there is a need for a packaging shipment pallet for large and sensitive equipment that will be able to reduce the shock g's g without incurring a resulting increase in vibration g's.

SUMMARY OF THE INVENTION

The present invention satisfies the requirement of reducing the shock g's without the usual increase in vibration g's, thus, breaking though the traditional design barrier for cushioned pallets.

The invention consists of a traditional 40 inch ×48 inch wood pallet with the addition of cushioned strips of two inch thick foamed polyethylene on the top of the three stringers (see FIG. 10A). The polyethylene foam strips are sandwiched between the stringers 24 and the top deck board 22. The center stringer cushion is made from nine pound density polyethylene 27 and the two outer stringers cushions are made from two pound density polyethylene 26. The placement of the nine pound density foam on the center stringer coupled with the placement of the two pound density foam on the outer stringers is key to the function of the invention. The lower density, two outer stringer cushions allow the pallet to absorb shocks while the higher density center stringer cushion acts like a automobile shock absorber to dampen vibration inputs. This load bearing tri-pod arrangement is a system that combines the shock absorbing characteristics of the lower density foam cushion with the vibration damping characteristics of the higher density foam cushion to produce the desired effect of reducing shock and vibration inputs with one pallet design. The unobvious part of the invention is the use of the tri-pod load bearing areas coupled with the different densities of foam to capture both shock absorption and vibration dampening characteristics of the different density cushions. The end result is a cushioning system that performs better in shock and vibration then either of the cushion densities could perform independently.

The advantages of the invention relate primarily to function and efficiency. The pallet is capable of reducing shock inputs of approximately 150 g's to 15 g's for equipment ranging in weight from 500 to 1000 lbs while reducing the random vibration inputs of 1.038 GRMS to 0.7743 GRMS with one pallet design. For efficiency, the amount of cushioning material is minimized thus, significantly reducing the cost. In addition, the pallet construction matches the industry standard size (40×48) which maximizes its handling efficiency in the distribution system.

A further understanding of the nature and advantages of the present invention may be realized by reference to the remaining portion of the specification and drawings.

BRIEF DESCRIPTION OF THE DRAWINGS

A complete understanding of the present invention may be gained by considering the following detailed description in conjunction with the accompanying drawing, in which:

FIG. 10A shows the inventive pallet.

FIG. 15A shows the top view of the inventive pallet, FIG. 15B shows the isometric view of the inventive pallet, FIG. 15 shows the front view of the inventive pallet, and FIG. 15D shows the right side view of the inventive pallet.

FIG. 17 shows the total packaging assembly as it would be used to packaging a piece of sensitive equipment.

DETAILED DESCRIPTION OF THE REFERRED EMBODIMENTS

Figure 1:
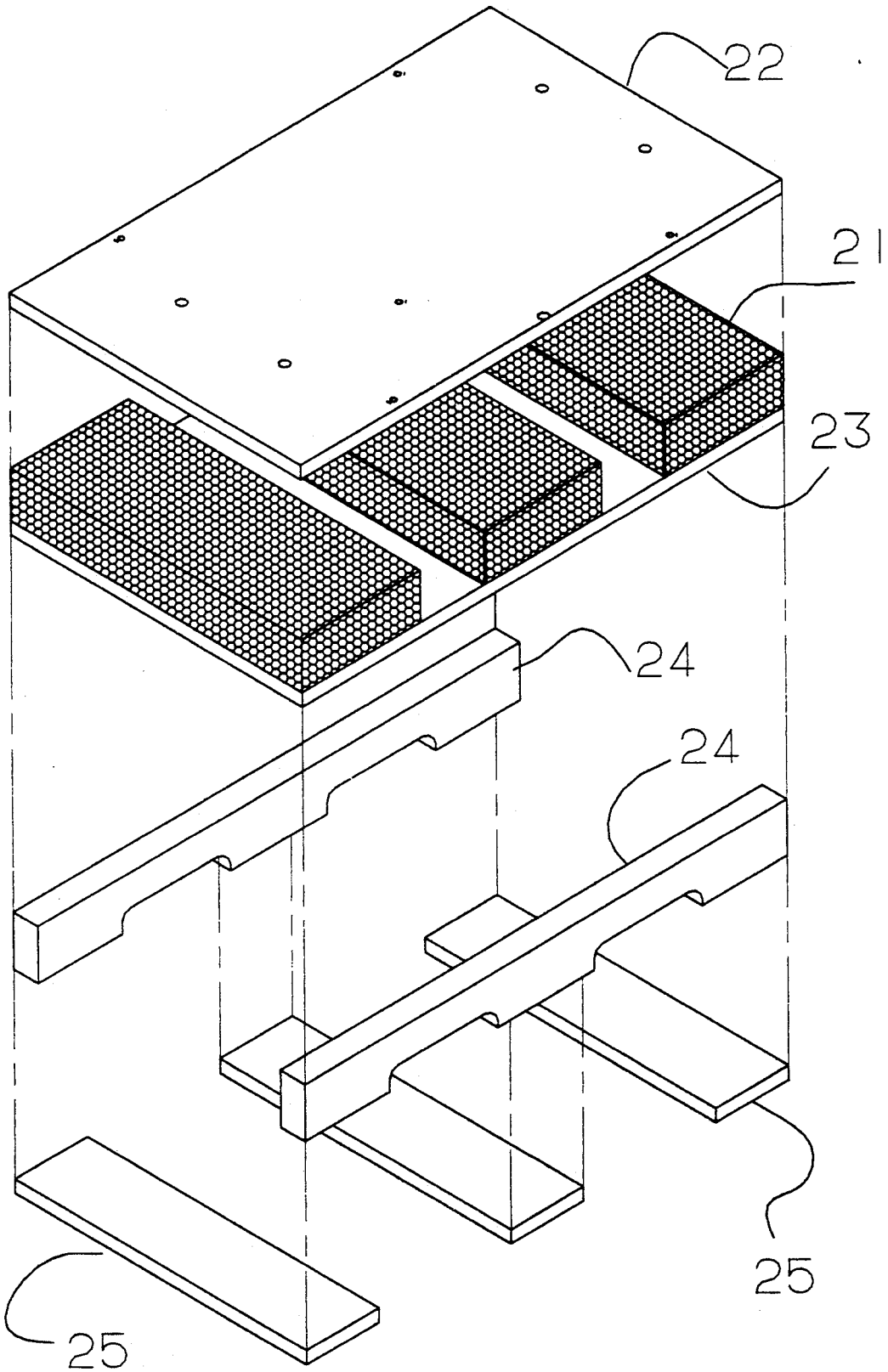
FIG. 1 shows, in pictorial form, an exploded isometric view of a prior art pallet.
Figure 2:
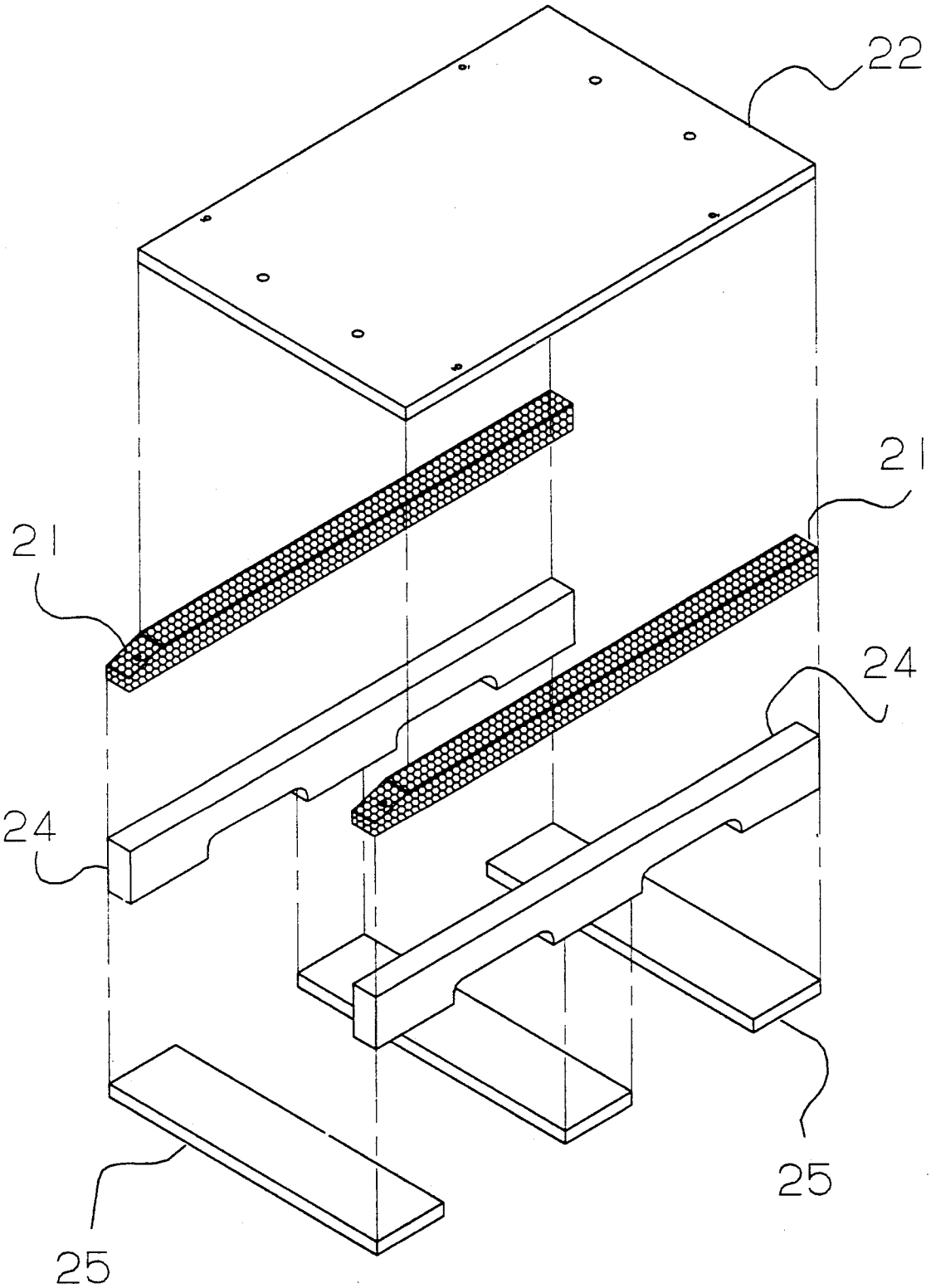
FIG. 2 shows, in pictorial form, an exploded isometric view of a prior art pallet.
Figure 3:
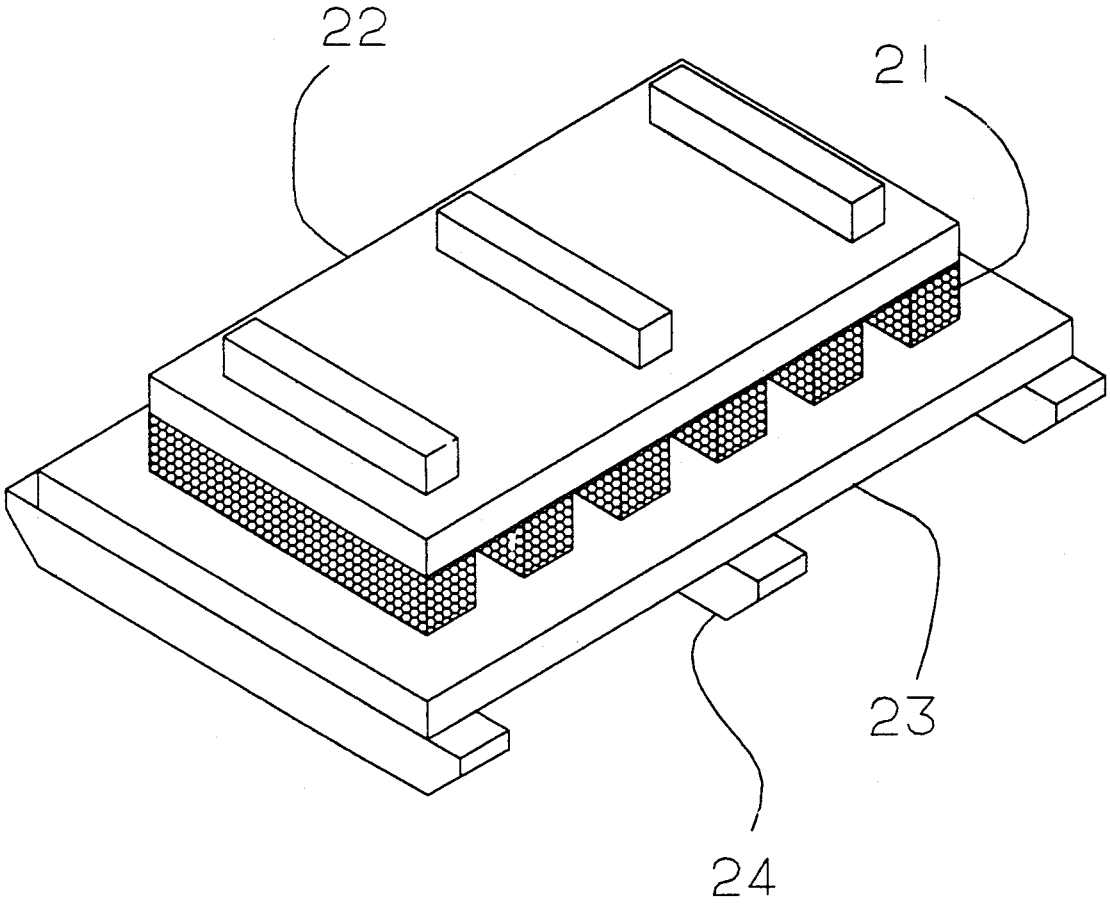
FIG. 3 shows, in pictorial form, an isometric view of a prior art pallet.
Figure 4A:
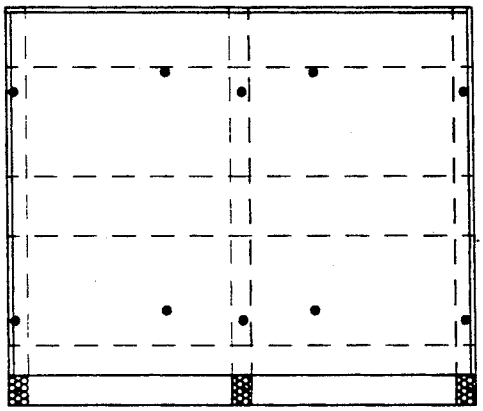
Figure 4B:
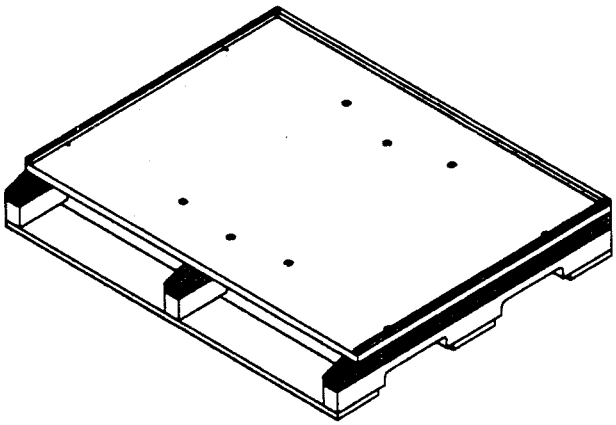
Figure 4C:
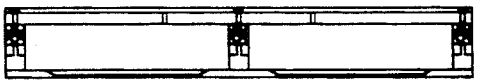
Figure 4D:
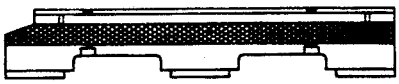
Figure 5:
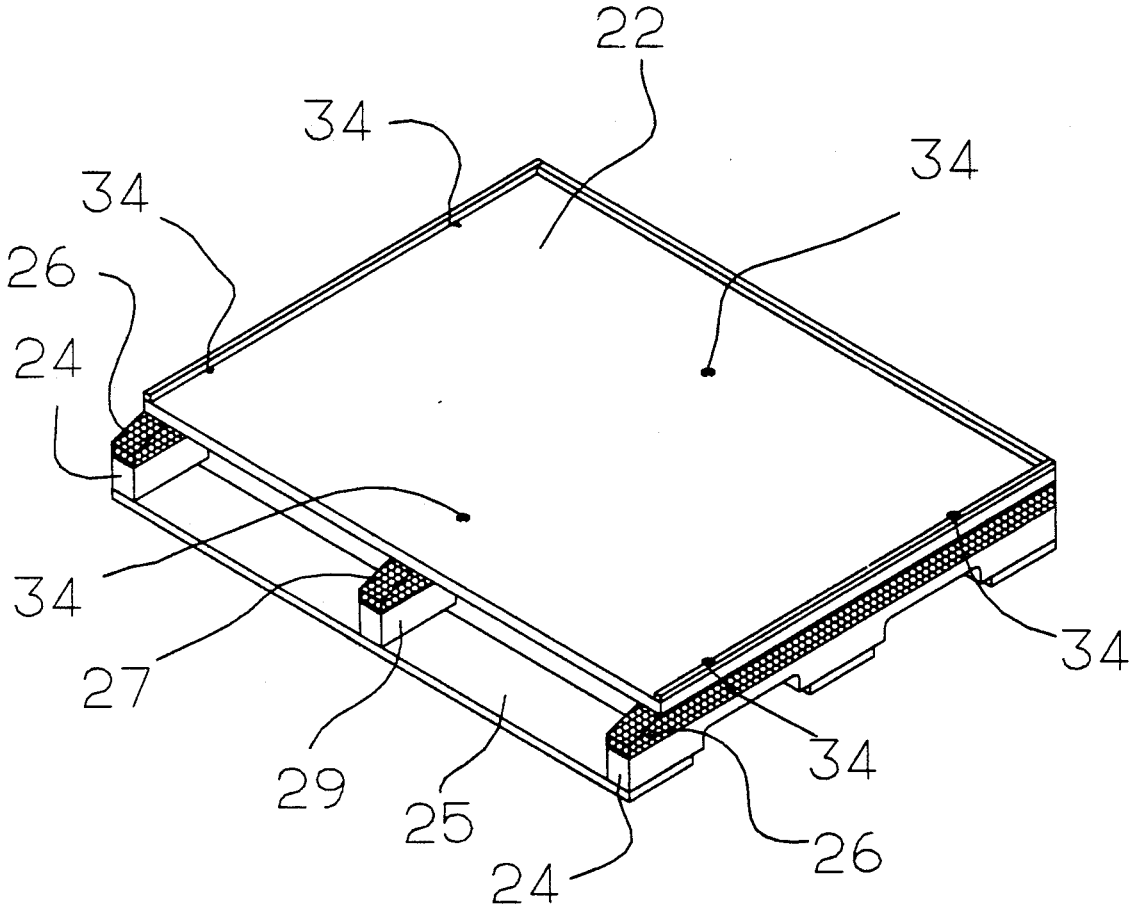
Figure 6:
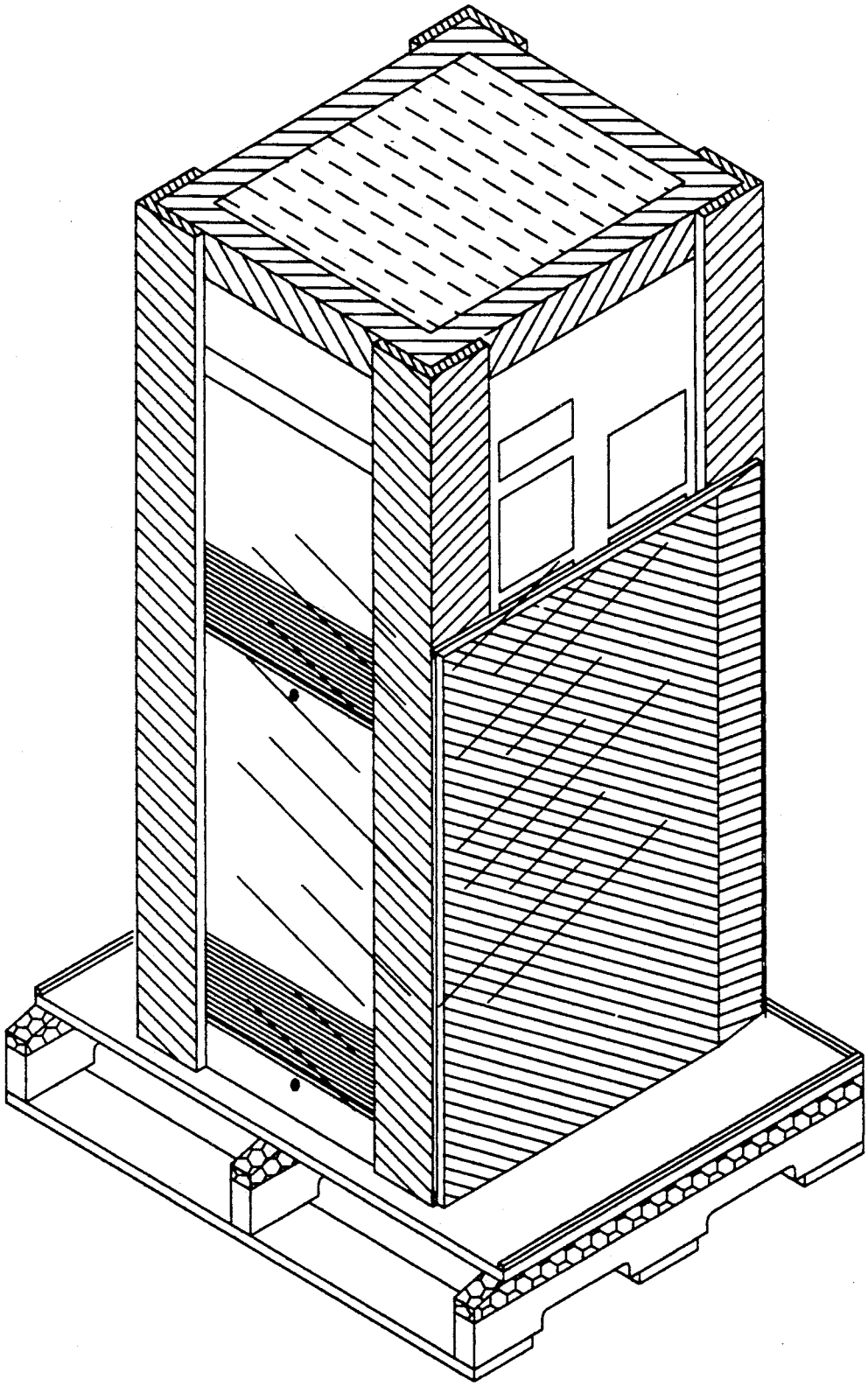

FIGS. 1 thru 3 show isometric and exploded views of prior art pallets. For each of these pallets the density and thickness of foam used was calculated using the standard formulas provided by the manufacturer of the foam cushions and strips of foam placed under the load bearing areas. There was not attempt, by any of the designs, to vary the density of foam used. For example (FIG. 1), if the calculations dictated the use of four pound density foam at two inches thick, the designer would place three pieces of four pound density foam between 22 and 23. The name is true for FIG. 3. If the calculations dictated the use of two pound density foam, the designer would place six pieces of two pound density foam between 22 and 23. My invention is to place different densities of foam, strategically located, to capture the shock and vibration characteristics of both densities to create a system that will avoid the trade-off between shock and vibration.

FIG. 10A shows an isometric view of the inventive pallet. It is constructed of a top deck 22, cushions 26 and 27, the stringers 24 and 29 and the bottom deck boards 25. The outside stringers 24 have a two inch high piece of two pound density foam on top. The center stringer 29 has a two inch high nine pound density foam on top. The foam strips 26 and 27 are sandwiched between the top deck board 22 and the stringers 24 and 29 respectively. The top deck board 22, foam strips 26 and 27, and the stringers 24 and 29 are held together with 3/8 inch bolts 34 placed vertically through the top deck board 22, foams strips 26 and 27, and the stringers 24 and 29 respectively.

FIG. 17 shows the entire packaging system with a piece of heavy sensitive equipment mounted to the pallet.

What is claimed is:

1. A shipment pallet for heavy and sensitive equipment, comprising:

(a) a first deck board, and (b) a first, a second, and a third stringer affixed to the said first deck board, the said second stringer being disposed between the said first and the said third stringer, and (c) a first foam cushion comprised of 2 pounds per cubic foot density polyethylene affixed to the top of the said first stringer as a means for absorbing shock, and (d) a second foam cushion comprised of 9 pounds per cubic foot density polyethylene affixed to the top of the said second stringer as a means for damping vibration, and (e) a third foam cushion comprised of 2 pounds per cubic foot density polyethylene affixed to the top of the said third stringer as a means for absorbing shock, and (f) a second deck affixed to the said first cushion, the said second cushion and the said third cushion, wherein the density of the second cushion is greater than the density of the first cushion and the density of the third cushion, and (g) the densities of the first cushion and the third cushion arc the same, and (h) the said first stringer, said second stringer, and said third stringer are parallel to each other, and (i) the first stringer and the third stringer are placed equidistant from the second stringer, whereby the tri pod construction with a denser, stiffer cushion centrally located underneath the second deck board, parallel to and equidistant from two less dense, softer cushions, produces the desired effect of reducing shock forces without the associated increase in vibration forces.

2. The pallet of claim 1 wherein the first deck is attached to the first stringer, the first stringer is attached to the first cushion and the first cushion is attached to the second deck, all with two, vertically inserted, ⅜ inch bolts equally spaced along the length of the first stringer.

3. The pallet of claim 1 wherein the first deck is attached to the second stringer, the second stringer is attached to the second cushion and the second cushion is attached to the second deck, all with two, vertically inserted, ⅜ inch bolts equally spaced along the length of the second stringer.

4. The pallet of claim 1 wherein the first deck is attached to the third stringer, the third stringer is attached to the third cushion and the third cushion is attached to the second deck, all with two, vertically inserted, ⅜ inch bolts equally spaced along the length of the third stringer.

* * * * *

UNITED STATES PATENT AND TRADEMARK OFFICE

CERTIFICATE OF CORRECTION

PATENT NO. : 5,195,439

DATED : March 23, 1993

INVENTOR(S) : Melvin Harder

It is certified that error appears in the above-indentified patent and that said Letters Patent is hereby corrected as shown below:

The title page, showing the illustrative figure, should be deleted and substitute therefor the attached title page.

Signed and Sealed this

Twenty-sixth Day of October, 1993

*Attest:*

Bruce Lehman

BRUCE LEHMAN

*Attesting Officer*

*Commissioner of Patents and Trademarks*

US005195439A

United States Patent [19]

Harder

[11] Patent Number: 5,195,439

[45] Date of Patent: Mar. 23, 1993

[54] SHIPMENT PALLET FOR HEAVY AND SENSITIVE EQUIPMENT

[76] Inventor: Melvin S. Harder, 2434 Alvardo Dr., Santa Clara, Calif. 95051-1305

[21] Appl. No.: 856,745

[22] Filed: Mar. 24, 1992

[51] Int. Cl.[5] ..... B65D 19/00

[52] U.S. Cl. ..... 108/51.1; 108/901

[58] Field of Search ..... 108/51.1, 51.3, 55.5, 108/55.1, 56.1

[56] References Cited

U.S. PATENT DOCUMENTS

| | | | |
|---|---|---|---|
| 4,809,847 | 3/1989 | Schneider | 206/45.31 |
| 4,927,026 | 5/1990 | Glosser | 206/600 |
| 5,039,036 | 8/1991 | Rogers | 244/138 |

FOREIGN PATENT DOCUMENTS

| | | | |
|---|---|---|---|
| 0671203 | 8/1989 | Switzerland | 108/51.1 |

*Primary Examiner*—Kenneth J. Dorner
*Assistant Examiner*—Gerald A. Anderson

[57] ABSTRACT

A cushioned pallet which combines the shock absorbing characteristics of lower density foam cushions with the vibration damping characteristics of higher density foam cushions. In particular, an inventive packaging pallet which utilizes a load bearing tri-pod arrangement with different density cushions strategically located to produce the desired effect of reducing both shock and vibration force inputs with one pallet design.

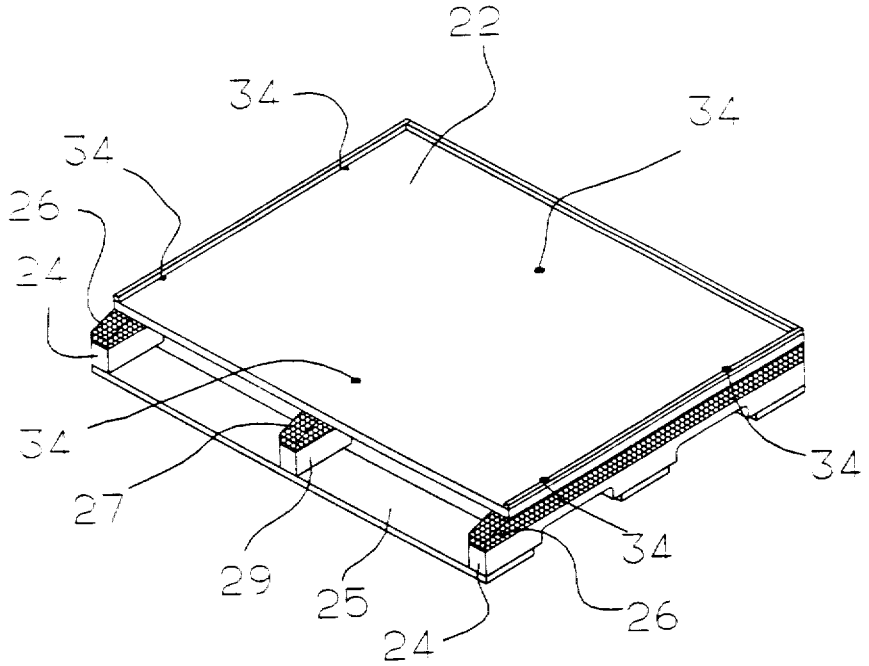

4 Claims, 6 Drawing Sheets